US006257830B1

(12) United States Patent
Matsuura et al.

(10) Patent No.: US 6,257,830 B1
(45) **Date of Patent: *Jul. 10, 2001**

(54) GAS TURBINE BLADE

(75) Inventors: Masaaki Matsuura; Kiyoshi Suenaga; Sunao Aoki; Kazuo Uematsu; Hiroki Fukuno; Yasuoki Tomita, all of Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/230,983

(22) PCT Filed: Jun. 3, 1998

(86) PCT No.: PCT/JP98/02454

§ 371 Date: Jun. 2, 1999

§ 102(e) Date: Jun. 2, 1999

(87) PCT Pub. No.: WO98/55735

PCT Pub. Date: Dec. 10, 1998

(30) Foreign Application Priority Data

Jun. 6, 1997 (JP) ..... 9-149234
Oct. 8, 1997 (JP) ..... 9-275798

(51) Int. Cl.[7] ..... F01D 5/18

(52) U.S. Cl. ..... 416/96 R; 416/96 A; 416/97 R; 415/115

(58) Field of Search ..... 416/96 R, 97 R, 416/96 A, 97 A, 95; 415/115, 114

(56) References Cited

U.S. PATENT DOCUMENTS

| | | | | |
|---|---|---|---|---|
| 2,700,530 | | 1/1955 | Williams . | |
| 3,370,829 | | 2/1968 | Banthin et al. . | |
| 4,073,599 | | 2/1978 | Allen et al. | 416/97 R |
| 4,136,516 | * | 1/1979 | Corsmeier | 416/96 R |
| 4,604,031 | * | 8/1986 | Moss et al. | 416/96 R |
| 4,992,026 | * | 2/1991 | Ohtomo et al. | 416/97 R |
| 5,318,404 | | 6/1994 | Carreno et al. | 416/96 R |
| 5,393,198 | * | 2/1995 | Noda et al. | 416/97 R |
| 5,403,159 | | 4/1995 | Green et al. | 416/97 R |
| 5,462,405 | | 10/1995 | Hoff et al. | 416/97 R |
| 5,536,143 | | 7/1996 | Jacala et al. | 416/96 R |
| 6,036,440 | * | 3/2000 | Tomita et al. | 416/96 R |

FOREIGN PATENT DOCUMENTS

| | | |
|---|---|---|
| 55-107005 | 8/1980 | (JP) . |
| 63-120802 | 5/1983 | (JP) . |
| 5-163959 | 6/1993 | (JP) . |
| 8-240102 | 9/1996 | (JP) . |
| 8-319852 | 12/1996 | (JP) . |

OTHER PUBLICATIONS

Communication from the European Patent Office dated Jan. 23, 2001.

* cited by examiner

*Primary Examiner*—Edward K. Look
*Assistant Examiner*—Richard Woo
(74) *Attorney, Agent, or Firm*—Sughrue, Mion, Zinn, Macpeak & Seas, PLLC

(57) ABSTRACT

In a steam cooling system proposed heretofore, high-pressure steam is supplied into an internal space of a blade for effecting cooling thereof with the high-pressure steam to thereby recover heat energy. This system however suffers from problems concerning the strength of the blade and the like. The present invention solves these problems and provides a gas-turbine blade which does not suffer from problems concerning the strength thereof nor problems concerning the flow of high-pressure steam. To this end, a coolant flow passage is formed within the blade extending in the longitudinal direction of the blade, and reinforcing ribs which interconnects a dorsal wall and a ventral wall of the blade is disposed within the coolant flow passage so as to extend in the flow direction of the coolant. Hence, the strength of the blade can be ensured without any obstacle to the flow of the coolant.

5 Claims, 5 Drawing Sheets

GAS TURBINE BLADE

BACKGROUND OF THE INVENTION

1. Technical Field of the Invention

The present invention relates to a gas-turbine blade provided with a steam-cooled structure.

2. Related Art

In recent years, it has been thought of to use steam in place of air for cooling the blades of a gas turbine in a combined cycle power plant, and to recover the steam used for cooling the blades without discharging it into a main gas flow with a view to improving the thermal efficiency of the gas turbine, (see, for example, Japanese Patent Application Laid-open No. 8-319803)). However, such approach has not yet found practical application.

With such steam cooling system, heat energy from the gas turbine carried by the recovered steam can be utilized in a steam turbine, whereby efficiency of the plant on the whole can be protected against degradation. Further, by suppressing the amount of cooling medium or coolant fed to the gas turbine, turbine efficiency can be enhanced. Additionally, by using steam as the coolant instead of air, heat transfer performance can be significantly enhanced without the need for changing or altering the geometrical configuration of the existing coolant flow passages.

A typical internal cooling structure of a moving blade in a conventional heat recovery type steam-cooled gas turbine, such as mentioned above, is shown in FIGS. 5*a* and 5*b*. Moreover, FIG. 5*a* is a vertical section of a blade, and FIG. 5*b* is a sectional view of same along the line 5B—5B in FIG. 5*a*.

Steam for cooling the moving blade 1 is supplied through a cooling steam inlet port 8 provided in a lower end portion of the blade at a location close to a leading edge 5 of the blade, and the steam flows through a coolant flow passage 4 formed inside the moving blade 1 in a serpentine pattern, as indicated by the arrows. After having cooled the interior of the blade, the steam leaves the blade through a cooling steam outlet port 9 provided at a location close to the blade trailing edge 6 and is subsequently introduced into a recovery system not shown.

Further, a plurality of turbulence promoting fins 7 are formed on the inner surfaces of the coolant flow passage 4 in the blade, each extending in a direction substantially orthogonal to the flow of the coolant steam so as to promote internal heat transfer.

As mentioned previously, the coolant steam is recovered by equipment provided at a location downstream of the gas turbine. To this end, the pressure of the coolant steam within the blade is maintained higher than the pressure of gases flowing outside of the blade by, 2 to 4 MPa. Hence, the blade is subjected to internal pressures which may exceed a permissible limit predetermined by the strength of the hollow blade with a thin structure, thus involving deformation (bulging) of the blade and hence fluid delamination of the working gas flowing along the external surface of the blade, to incur such problems as degradation in the performance of the blade and the like. Thus, there exists a demand for a blade with a structure which can at least withstand the internal pressure mentioned above.

SUMMARY OF THE INVENTION

In order to meet the demand mentioned above, an object of the present invention is to provide a gas-turbine blade in which strength can be reliably ensured without impairing the advantages of the steam cooling system designed to improve the thermal efficiency of the gas turbine to thus be able to freely enjoy such advantages.

The present invention has been made to achieve the object described above and provides a gas-turbine blade having a coolant flow passage formed to extend longitudinally in an inner portion of the blade, wherein a reinforcing rib or ribs are provided within the coolant flow passage so as to extend in a flow direction of a coolant and connect a dorsal wall and a ventral wall of the blade.

By connecting the dorsal wall and the ventral wall of the blade by means of reinforcing rib or ribs, the blade can be imparted with sufficient strength for withstanding a force applied by a pressure difference between the high-pressure steam flowing inside of the blade and the gas flowing outside of the blade. Further, since the reinforcing rib or ribs are disposed so as to extend in the direction in which the coolant flows through the coolant flow passage, the high-pressure steam serving as the coolant encounters essentially no obstacle in flowing through the coolant flow passage. Thus, the flow of the coolant is not essentially effected by the presence (or absence) of the reinforcing rib or ribs, whereby the desired cooling effect as aimed can be achieved.

Further, the present invention provides a gas-turbine blade, in which the coolant flow passage is formed, being partitioned by a partition wall or walls, and in which the reinforcing rib is disposed at such a position that coolant flow passage portions located at right and left sides of the reinforcing rib or ribs, together with the partition walls located adjacent to the reinforcing rib are not blocked.

More specifically, by positioning and disposing the reinforcing rib or ribs between the adjacent partition walls defining the coolant flow passage, preferably at a central position between the adjacent partition walls which cooperate to form the coolant flow passage, so as not to block the coolant flow passage, the width of the coolant flow passage is correspondingly decreased, which is effective for preventing the deformation of the blade (bulging) by the pressure difference between the coolant steam pressure within the coolant flow passage and the main gas flow.

With the blade structure mentioned above, the blade can be protected against deformation even when a coolant steam of higher pressure than that of the main gas flow is used, whereby degradation of the blade performance which may otherwise be brought about by so-called fluid delamination due to blade deformation can be suppressed or prevented.

Furthermore, the present invention provides a gas-turbine blade, in which the coolant flow passage portions located at left and right sides of the reinforcing rib or ribs are each formed as independent structures, such that the coolant flow passage portions exhibit independent flow characteristics.

In other words, the reinforcing rib or ribs are not simply disposed within the coolant flow passage but disposed such that the coolant flow passage portions defined at the left and right sides thereof can be constructed independently according to the characteristics of the coolant steam flowing through the respective coolant flow passage portions. Hence, efficient heat exchange and heat recovery can be achieved.

Furthermore, the present invention provides a gas-turbine blade, in which the blade is structured so that the coolant steam fed to the coolant flow passage and recovered therefrom is fed through an inlet port projecting forwardly from a root portion of the blade and recovered through an outlet port projecting rearwardly from the blade root portion.

More specifically, in the inlet port for feeding the coolant steam into the coolant flow passage and the outlet port for recovering the coolant steam having performed a cooling operation and received the heat from the turbine blade, there is high possibility of steam leakage. Moreover, it is to be noted that these ports are formed so as to project forwardly and rearwardly, respectively, from the blade root as described above. Hence, the machining of these portions, including connecting structures, etc., is facilitated, while the leakage of the steam at the connecting portions which degrades the operating efficiency can be appropriately and reliably prevented.

Furthermore, the present invention provides a gas-turbine blade, in which the reinforcing rib or ribs are disposed only within a portion of the coolant flow passage which is located adjacent to the blade trailing edge, while the other portion of said coolant flow passage is partitioned a number of times at short intervals such that the cross-sections thereof are approximately circular.

More specifically, when the coolant flow passage is partitioned a number of times at short intervals such that the cross-sections thereof are approximately circular, there is no need to provide the reinforcing rib or ribs within the coolant flow passage portions each having approximately circular cross-sections. Accordingly, reinforcing ribs are not disposed in the coolant flow passage portions having the approximately circular cross-sections but may be selectively disposed in only the coolant flow passage portion extending adjacent to the blade trailing edge which has a narrow cross-section and which is difficult to form with a roughly circular cross-section. Hence, the cost involved in designing and manufacturing the blade in which the reinforcing ribs are disposed over the entire blade can be eliminated while sufficient strength can be ensured for the blade as a whole.

Furthermore, the present invention provides a steam-cooled blade to which the coolant steam is fed from a hub side at the blade trailing edge, wherein the coolant flow passage portion located closest to the blade trailing edge is made wide to facilitate the flow of the coolant steam, while an end portion of the reinforcing rib disposed adjacent to the blade trailing edge is bent curvilinearly toward a corner portion of the blade. Thus, the flow of the coolant steam at the corner portion of the blade can be facilitated and the blade cooling performance can be enhanced.

BRIEF DESCRIPTION OF THE DRAWINGS

FIGS. 1*a* and 1*b* show a steam-cooled moving blade for a gas turbine according to a first embodiment of the present invention, wherein FIG. 1*a* is a vertical sectional view of same, and FIG. 1*b* is a cross-sectional view taken along line 1B—1B in FIG. 1*a*.

FIGS. 2*a* and 2*b* show a steam-cooled moving blade for a gas turbine according to a second embodiment of the present invention, wherein FIG. 2*a* is a vertical sectional view of same, and FIG. 2*b* is a cross-sectional view taken along line 2B—2B in FIG. 2*a*.

FIGS. 3*a* and 3*b* show a steam-cooled moving blade for a gas turbine according to a third embodiment of the present invention, wherein FIG. 3*a* is a vertical sectional view of same, and FIG. 3*b* is a cross-sectional view taken along line 3B—3B in FIG. 3*a*.

FIGS. 4*a* and 4*b* show a steam cooling type gas-turbine according to a fourth embodiment of the present invention, wherein FIG. 4*a* is a vertical sectional view of same, and FIG. 4*b* is a cross-sectional view taken along line 4—4 in FIG. 4*a*.

FIGS. 5*a* and 5*b* show a conventional steam-cooled moving blade for a gas turbine, wherein FIG. 5*a* is a vertical sectional view of same, and FIG. 5*b* is a cross-sectional view taken along line 5B—5B in FIG. 5*a*.

DETAILED DESCRIPTION OF THE PREFERRED EMBODIMENTS

Figure 1A:
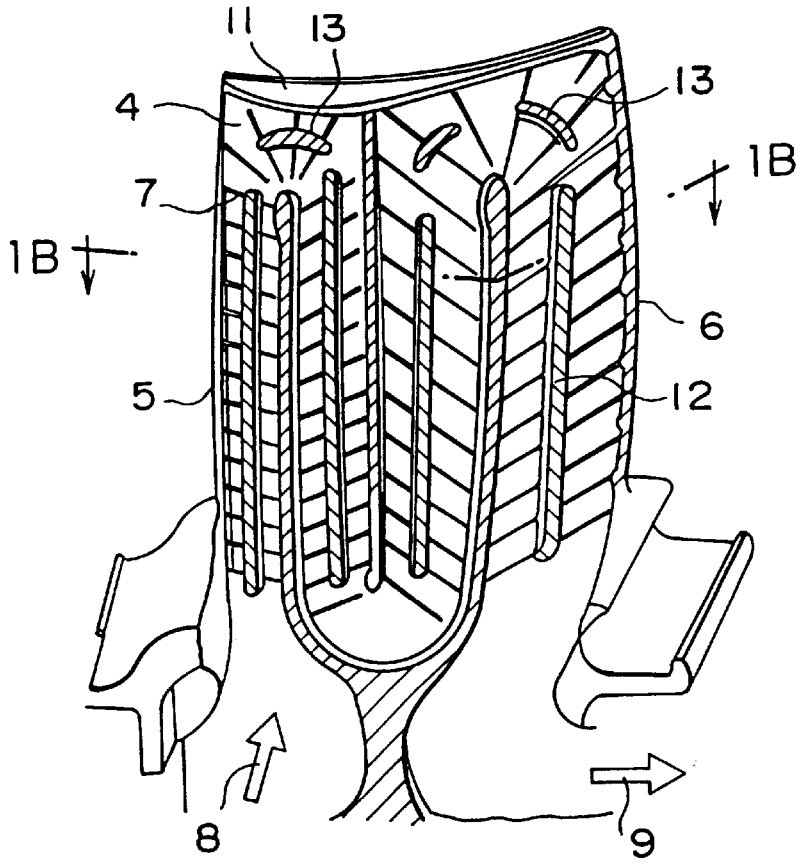
Figure 1B:
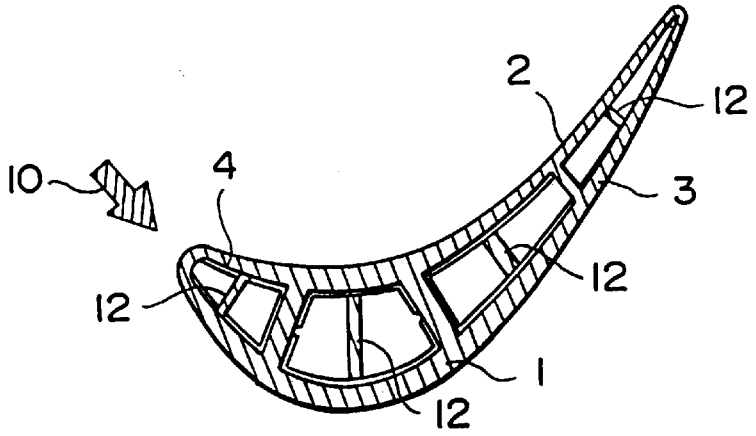

A first embodiment of the present invention will be described with reference to FIG. 1*a* and FIG. 1*b*. FIG. 1*a* shows a vertical section of a steam-cooled moving blade for a gas turbine, and FIG. 1*b* shows a cross-sectional view of same taken along line 1B—1B in FIG. 1*a*. Further, same parts or portions as those of the conventional blade structure described hereinbefore are denoted by like reference numerals in the figures, hence their description is omitted here.

According to the instant embodiment of the invention, reinforcing ribs 12 are disposed so as to extend longitudinally in a substantially center portion of a coolant flow passage 4 which reciprocatively extends longitudinally from a blade root to a blade tip 11, and then from the blade tip 11 to the blade root so as to be an interconnected serpentine pattern in an inner portion of a moving blade 1, and connect a ventral wall 2 and a dorsal wall 3.

Further, reinforcing ribs 13 with short lengths and which are bent to conform to the curves of turn-around portions are disposed, respectively, at each turn-around portion of the serpentine coolant flow passage 4 in the regions located near the blade tip end portion 11.

With the blade structure according to this embodiment of the present invention, which incorporates the reinforcing ribs 12 and 13 disposed within the coolant flow passage 4 as described above, a sufficiently high strength can be ensured for the blade so that the moving blade 1 can withstand a force applied thereto under the pressure difference (ordinarily in a range of 2 to 4 MPa) between the coolant steam of high pressure flowing through the coolant flow passage 4 and a main gas flow 10 flowing outside of the moving blade 1.

Since the reinforcing ribs 12 are disposed in the longitudinal direction of the blade in which the coolant flow passage 4 extends, the reinforcing ribs 12 are oriented parallel to the flow of the coolant steam. This is preferable for suppressing the occurrence of turbulence in the coolant steam flow. Moreover, since the reinforcing ribs 13 are bent curvilinearly along the turn-around path of the coolant flow passage 4, the coolant steam flow can be introduced smoothly to the blade tip 11. Furthermore, compared with the conventional moving blade in which the reinforcing ribs 12 and 13 are not provided, no special difference can be found with regard to the flow of the coolant steam. Thus, with the blade structure according to the instant embodiment of the invention, the desired cooling effect can be achieved without degrading the advantageous effects which can be obtained by using steam as the coolant.

With regard to shape of the reinforcing ribs 12 and 13, it is to be mentioned that the reinforcing ribs 12 and 13 are shaped so as to incur less pressure loss hydrodynamically, i.e., by rounding the leading edges and trailing edges of the reinforcing ribs 12 and 13, while concerning the size of the reinforcing ribs, the width thereof should be determined so as to be capable of exhibiting sufficiently high strength to withstand the tension applied from the ventral wall 2 and the dorsal wall 3 of the moving blade 1. Of course, in practical applications, the concrete dimensions of the reinforcing ribs 12 and 13 may be determined in consideration of the scale of the turbine used.

Figure 2A:
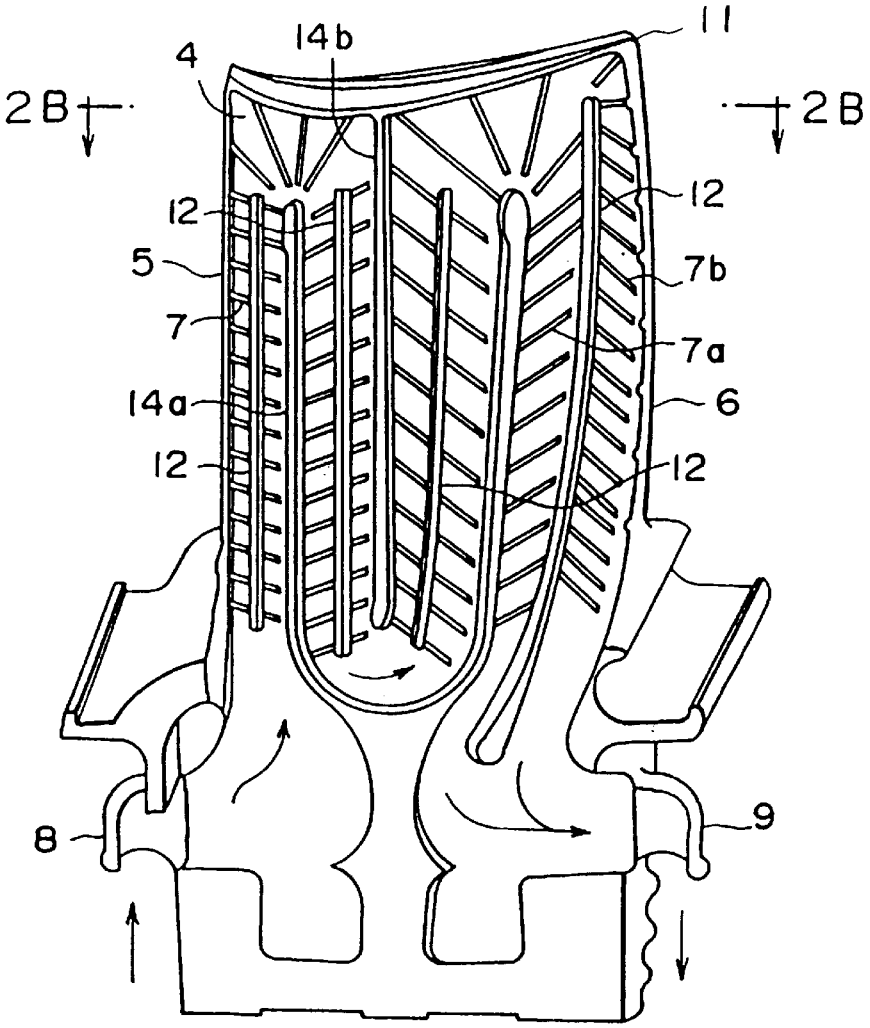
Figure 2B:
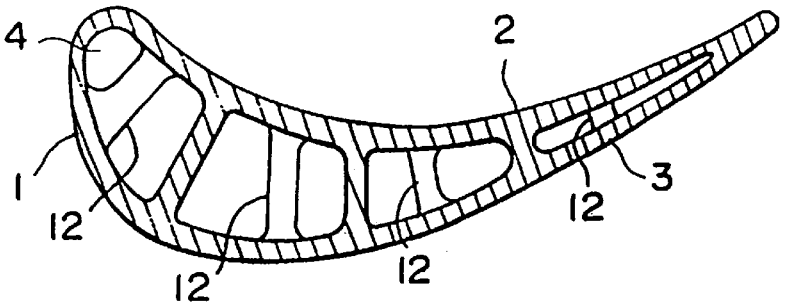

Next, a second embodiment of the present invention will be described with reference to FIG. 2*a* and FIG. 2*b*. FIG. 2*a* shows a vertical section of a steam-cooled moving blade of a gas turbine, and FIG. 2*b* shows a cross-sectional view of same taken along line 2B—2B in FIG. 2*a*.

Further, same parts or portions as those of the conventional structure and the first embodiment of the invention described hereinbefore are denoted by like reference numerals, and the repetitive description thereof is omitted. The following description will be made stressing the features which differ from the former.

According to the instant embodiment, a coolant flow passage 4, being bent in a serpentine pattern, is formed by a U-shape partition wall 14*a* and an I-shape partition wall 14*b* which is inserted at a center portion of the U-shape partition wall 14*a*, wherein reinforcing ribs 12 are disposed at substantially central positions between the U-shape partition wall 14*a* and the I-shape partition wall 14*b* for ensuring the strength of the blade at portions which correspond to the coolant flow passage 4.

Paying particular attention to the portion of the coolant flow passage 4 which is formed at a location close to the blade trailing edge 6, it can be seen that turbulence promoting fins (turbulators) 7*a* and 7*b* formed at the right and left sides, respectively, of the reinforcing rib 12 disposed within the coolant flow passage 4 present some aspects which differ from the corresponding structure of the reinforcing rib 12 disposed in the other portion of the coolant flow passage 4.

More specifically, in the other portion of the coolant flow passage 4, an arrangement is adopted in which the reinforcing ribs 12 are simply disposed on the turbulence promoting fins 7 which extend uniformly over the entire width of the coolant flow passage 4. However, in the portion of the coolant flow passage 4 located near the blade trailing edge 6, the turbulence promoting fins 7 are independently arrayed at the left and right sides of the reinforcing rib 12.

More specifically, the turbulence promoting fins 7*a* and the turbulence promoting fins 7*b* disposed at the left and right sides of the reinforcing rib 12 located near the blade trailing edge differ from each other with regard to the direction of inclination and the number of fins (mesh of the array).

The position of each turbulence promoting fin mentioned above is adopted in consideration of the fact that the behavior of the coolant steam flowing at one side of the reinforcing rib 12 differs somewhat from that of the coolant steam flowing at the other side. Accordingly, in the case of this embodiment of the invention, the turbulence promoting fins are arrayed so that a flow of the coolant steam appropriate for the desired behavior of the coolant steam at the respective location can be obtained, and thus, efficient heat exchange and heat recovery is obtained.

Furthermore, in the blade according to the present embodiment, a coolant steam inlet port 8 is provided at the blade root portion of the moving blade 1 so as to project slightly forwardly at the leading edge side while a coolant steam outlet port 9 is so provided at the trailing edge side as to project slightly rearwardly.

Generally, in a steam cooling system, it is required that no leakage occur at any intermediate portion of a coolant steam feed path for feeding the coolant steam and a recovery path for recovering the steam after the cooling of the blades. Moreover, by forming the coolant steam inlet port 8 and the coolant steam outlet port 9 serving as the coupling portions for the blade 1 so that they project outwardly, leakage of the steam at these portions can be reliably prevented while providing preferable working conditions to facilitate the work involved in forming these inlet and outlet portions.

Figure 3A:
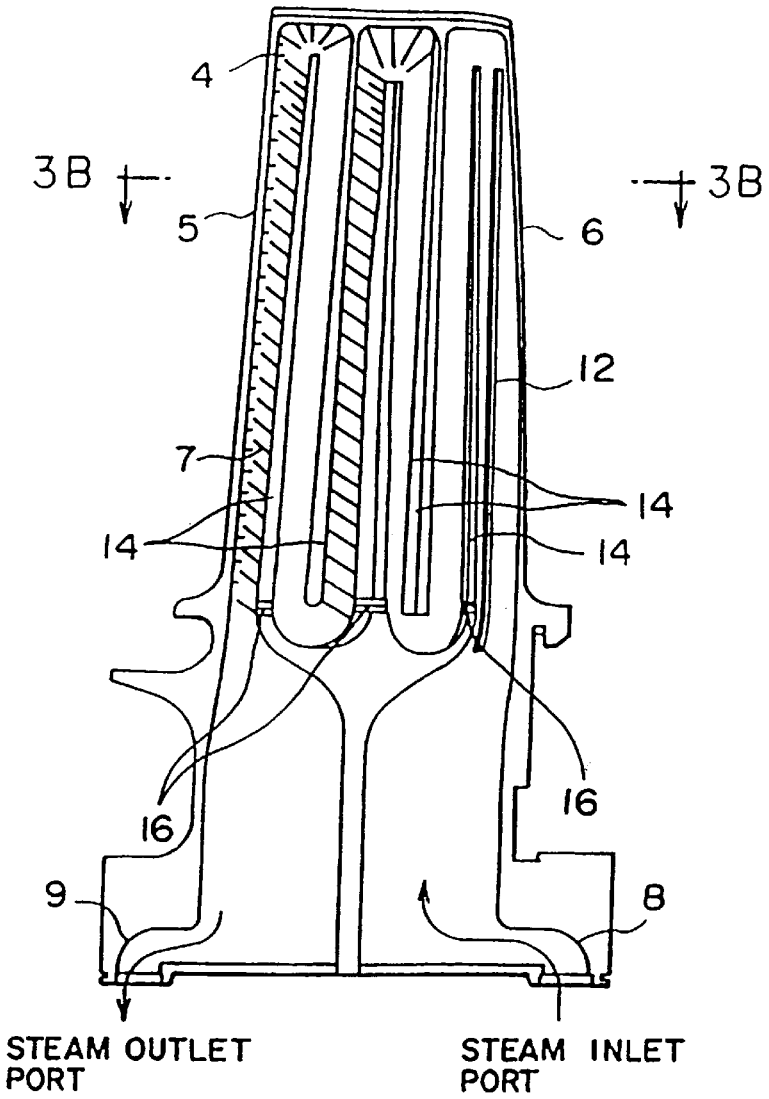
Figure 3B:
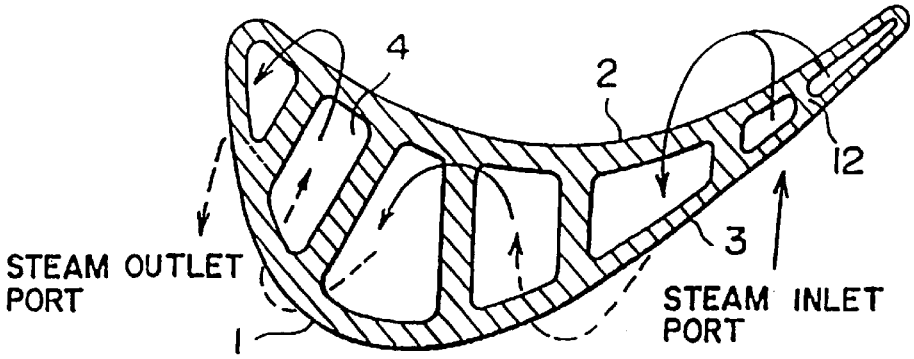

Next, a third embodiment of the present invention will be described with reference to FIG. 3*a* and FIG. 3*b*. FIG. 3*a* shows a vertical section of a steam-cooled moving blade of a gas turbine, and FIG. 3*b* shows a cross-sectional view of same taken along line 3B—3B in FIG. 3*a*.

Further, same parts or portions as those of the conventional structure and the first and second embodiments of the present invention described hereinbefore are denoted by like reference numerals, and the repetitive description thereof is omitted. The following description will be made stressing the features which are different.

In the blade according to the instant embodiment, the reinforcing ribs 12 are disposed in association with only the portion of the serpentine coolant flow passage 4 that is located close to the blade trailing end of the moving blade 1.

More specifically, in the case of the blade according to the instant embodiment, a greater number of partition walls 14 are employed for defining the coolant flow passages 4 bent in the serpentine pattern formed in an inner portion of the moving blade 1. Thus, the interior of the blade 1 is partitioned more finely (e.g. partitioned into six portions rather than four portions in the ordinary array), whereby each portion of the coolant flow passage 4 is formed to have an approximately circular in cross-section, which contributes to increasing the strength of the blade.

However, since the intrinsic shape of the moving blade 1 is such that the blade trailing edge is thin, the partition wall 14 is not provided to form the portion of the coolant flow passage 4 located along the trailing edge in an approximately the circular shape. Instead, the reinforcing ribs 12 are provided in this portion in order to ensure the strength of the blade.

Thus, according to the instant embodiment of the invention, the partition walls 14 are disposed at short intervals in a region extending from the blade leading edge of the moving blade 1 to the central portion thereof and hence to the one immediately before the trailing edge, and the coolant flow passage 4 is strengthened because it has an approximately circular cross-section. Moreover, the reinforcing ribs are disposed selectively within only the portion of the coolant flow passage 4 that is located along the blade trailing edge where difficulty is encountered in forming the slender cross-section of the coolant flow passage 4 to be approximately circular. Consequently, the expense involved in designing and manufacturing the blade having reinforcing ribs disposed all over can be eliminated while yet obtaining a blade having sufficient strength.

Additionally, it should be mentioned that in the blade according to the instant embodiment of the invention, bypass apertures 16 are provided in lower portions of the partition walls 14 for allowing parts of the coolant steam flowing through the coolant flow passage 4 to bypass the serpentine portions thereof, so that the temperature balance, etc. over the entire blade is regulated.

Figure 4A:
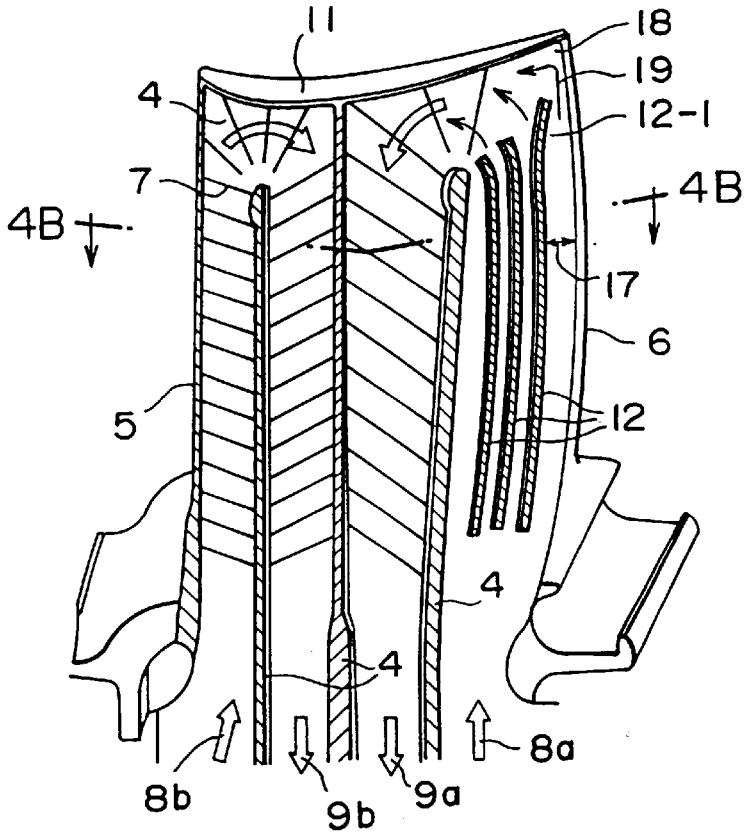
Figure 4B:
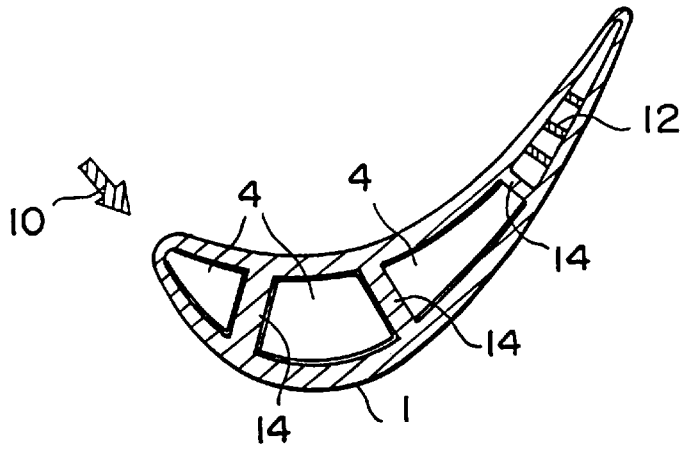
Figure 5A:
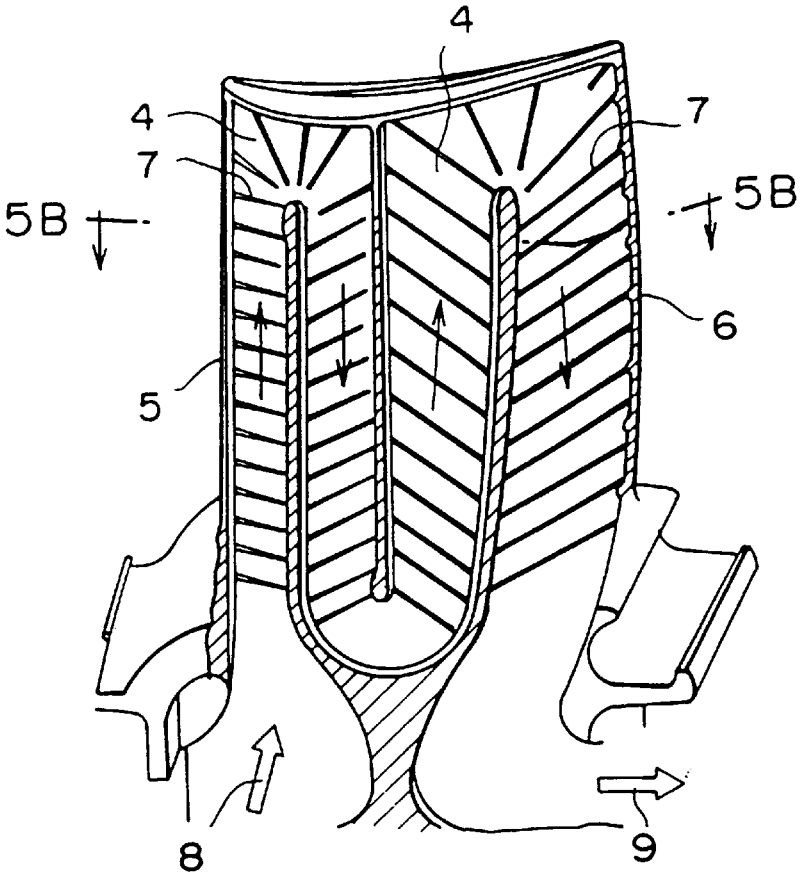
FIG. 5A (PRIOR ART)
Figure 5B:
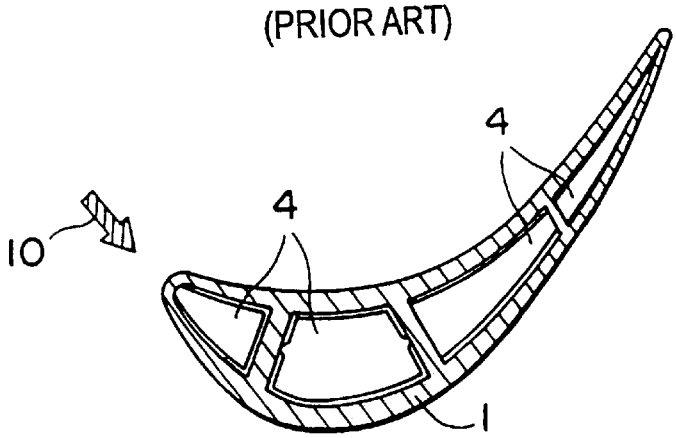
FIG. 5B (PRIOR ART)

FIGS. 4*a* and 4*b* show a sectional view of a steam-cooled moving blade for a gas turbine according to a fourth embodiment of the present invention, wherein FIG. 4*a* shows the moving blade in a cross-section taken in the radial direction of the gas turbine, i.e., in the longitudinal direction of the moving blade, and FIG. 4*b* shows a section of same taken along line 4B—4B in FIG. 4*b*.

In the case of the blade according to the instant embodiment, three reinforcing ribs 12 extending in the longitudinal direction of the moving blade 1 are disposed within the coolant flow passage 4 formed close to the trailing edge 6 of the blade and supplied with the coolant steam through a coolant steam inlet port 8*a* provided in the hub. Thus, the coolant flow passage 4 is partitioned into four passage portions.

The widths of the passage portions are such that the portion defined by the associated rib located nearest to the blade trailing edge 6 is the largest, as indicated by the pitch 17, while the widths of the other adjacent passage portions are narrow so that the passage portion located closest to the blade trailing edge 6 has the greatest width for allowing the coolant steam to flow easily.

Furthermore, an end 12-1 of the reinforcing rib 12 which is disposed closest to the blade trailing edge 6 and which is located near the blade tip 11 is bent so as to face a corner portion 18 of the moving blade 1 what is formed at a position where the blade tip 11 and the blade trailing edge 6 intersect each other. Thus, the flow of the coolant steam can reliably and sufficiently reach the corner portion 18.

By virtue of the blade structure according to the instant embodiment, the coolant steam supplied from a rotor, not shown, to the moving blade 1 by way of the coolant steam inlet port 8*b* formed at the blade leading edge side and the coolant steam inlet port 8*a* provided at the blade trailing edge side can flow through the coolant flow passages 4, communicated with the coolant steam inlet port 8*a* and the coolant steam inlet port 8b, turns around at the blade tip 11, and flows back to the hub by way of coolant steam outlet ports 9*a* and 9*b*.

At this time, the portion of the coolant flow passage 4 located nearest the blade trailing edge 6 is finely partitioned a number of time at short intervals by disposing a reinforcing rib or ribs 12 within the coolant flow passage 4 in such manner as mentioned previously, wherein the passage portion located closest to the blade trailing edge 6 has a greater width or pitch 17 so that the passage portion space adjacent to the blade trailing edge 6 has a large width for allowing the coolant steam to flow easily therethrough (notwithstanding the fact that blade thickness is reduced at the blade trailing edge 6), whereas the intervals between the reinforcing ribs 12 located farther from the blade trailing edge 6 are short, making it difficult for the coolant steam to flow compared to the steam flowing through the passage portion located nearest to the trailing edge. Thus, the coolant steam supplied to the portion where it is difficult for the coolant steam to flow is forced to flow through the passage portion located closest to the blade trailing edge 6 where it is easy for the coolant steam to flow. In this manner, a sufficient cooling effect can be ensured even for the passage portion of the internal coolant flow passage located close to the blade trailing edge 6.

Moreover, since the end 12-1 of the reinforcing rib 12 which defines the passage portion of the coolant flow passage 4 located closest to the trailing edge 6 is curvilinearly bent toward the corner portion 18 of the blade at the blade tip 11, a stream 19 of the coolant steam is formed which flows along the reinforcing rib 12 and turns around at the corner portion 18, whereby occurrence of a dead region to which no coolant steam is fed can be avoided. Thus, a high convection heat transfer ratio can be achieved over the entire area of the coolant flow passage 4 including the passage portion located closest to the blade trailing edge 6.

For the reasons mentioned above, the internal cooling can be assured even for the thin portion of the blade trailing edge portion 6, which has heretofore presented a difficult problem in design and manufacture of the cooling structure for the steam-cooled blade of the coolant steam recovery type gas turbine.

Although it has been described above that the passage portion of the coolant flow passage 4 located closest to the blade trailing edge 6 is partitioned into four flow channels by disposing three reinforcing ribs 12, the present invention is not restricted to any specific number of the reinforcing ribs 12 and the flow channels. It goes without saying that the numbers mentioned above can be altered appropriately depending on the shape of the moving blade 1 and the scale of the gas turbine used in practical application.

Further, although it has been described that the coolant flow passage 4 is at a minimum a serpentine pattern which extends from the hub, turns around at the blade tip 11 and extends backward to the coolant steam outlet ports 9*a* and 9*b*, it goes without saying that a large scale serpentine structure in which the coolant steam is forced to turn around an arbitrary number of times can be adopted depending on the design and manufacturing requirements.

In the foregoing, the present invention has been described in conjunction with the illustrated embodiments. Nevertheless, the present invention is not restricted to these embodiments. It goes without saying that various alterations and modifications may be made to the structure and arrangement without departing from the scope of the invention.

As is apparent from the foregoing description, according to the present invention, by providing the reinforcing rib or ribs within the coolant flow passage internally formed in the moving blades, the blade can be obtained which is capable of withstanding the force brought about under the pressure difference between the high-pressure steam flowing through the interior of the blade and the main gas stream flowing outside of the blade, and which has high safety and stability.

Moreover, since the reinforcing ribs are structured such that individual reinforcing ribs extend substantially in parallel with the flow of the coolant steam, a blade can be obtained in which the coolant steam flows through the internal passage(s) as smoothly as in the blade where no reinforcing ribs are provided. Thus, the desired effects can be achieved without degrading the internal convection cooling performance.

Also, by virtue of the features mentioned above, the strength of the blade can be ensured without impairing the advantages obtained by using steam instead of air for cooling the blade to improve the thermal efficiency of the gas turbine. Consequently, the efficiency of the gas turbine and the plant as a whole can be increased.

Moreover, according to another aspect of the present invention, in a blade in which the reinforcing ribs are disposed in the coolant flow passage defined by the partition walls, the reinforcing ribs are disposed at a position such that the passage portion formed between the reinforcing rib and the adjacent partition wall at the left or right side thereof is not blocked. More specifically, by disposing the reinforcing ribs, at a central position relative to the adjacent partition wall, which together with the reinforcing ribs forms the coolant flow passage, so as not to block the coolant flow passage, the width of the coolant flow passage is decreased. This is effective for suppressing deformation of the blade under the pressure difference between the coolant steam pressure within the coolant flow passage and that of the main gas stream. With the blade structure mentioned above, the blade can be protected against deformation even when the pressure of the coolant steam is higher than that of the main gas stream, whereby degradation of the blade performance which may otherwise be brought about by so-called fluid delamination caused by blade deformation or bulging can be prevented.

Further, according to yet another aspect of the present invention, the passage portions defined at the left and right sides of the reinforcing rib or ribs disposed within the coolant flow passage formed within the gas-turbine blade are each formed with an independent structure and exhibit independent flow characteristics.

In other words, the reinforcing rib or ribs are not simply disposed within the coolant flow passage but disposed such that the coolant flow passage portions located at the left and right sides thereof can be constructed independent from each other with appropriate configurations according to the characteristics of the coolant steam flowing through the respective coolant flow passage portions. Hence, efficient heat exchange and heat recovery can be achieved.

Further, according to an another aspect of the present invention, the coolant steam, fed to the coolant flow passage formed within the gas-turbine blade and then recovered therefrom, is fed through the inlet port projecting forwardly from the blade root and recovered through the outlet port projecting rearwardly from the blade root.

More specifically, in the inlet port for feeding the coolant steam into the coolant flow passage and the outlet port for recovering the coolant steam having performed the cooling operation and received the heat from the turbine blade, there is a high possibility of steam leakage. Moreover, it is to be noted that these ports are formed so as to project forwardly and rearwardly, respectively, from the blade root portion as described above. Hence, the machining of these portions, including connecting structures, etc., can be facilitated, while the leakage of the steam at the connecting portions which degrades the operating efficiency can be appropriately and reliably prevented.

Furthermore, in a preferred mode of carrying out the present invention, the reinforcing rib or ribs to be disposed within the coolant flow passage formed within the gas-turbine blade are provided only within the portion of the coolant flow passage located adjacent to the blade trailing edge, while the other portion of said coolant flow passage is partitioned a number of times at short intervals such that the cross-sections thereof are approximately circular.

More specifically, when the coolant flow passage is partitioned a number of times at short intervals such that the cross-sections thereof are approximately circular, there is no need to provide the reinforcing rib or ribs within the portions of the coolant flow passage each having approximately circular cross-sections.

Accordingly, reinforcing ribs are not disposed in the coolant flow passage portions having the approximately circular cross-sections but may be selectively disposed in only the coolant flow passage portion extending adjacent to the blade trailing edge which has a narrow cross-section and which is difficult to form with a roughly circular cross-section. Hence, the cost involved in designing and manufacturing the blade in which the reinforcing ribs are disposed over the entire blade can be eliminated while sufficient strength can be ensured for the blade as a whole.

Additionally, according to the present invention, in a steam-cooled blade in which the coolant steam is fed from the hub side at the blade trailing edge, the portion of the coolant passage formed along the blade trailing edge is partitioned a number of times by ribs extending in the longitudinal direction of the blade. The portion of the coolant flow passage located closest to the blade trailing edge is made wide to facilitate the flow of the coolant steam, while the end of the reinforcing rib disposed adjacent to the blade trailing edge is curved toward the corner portion of the blade. Hence, the portion of the coolant flow passage at the inherently thin blade trailing edge may be partitioned a number of times by ribs extending in the longitudinal direction of the blade. The portion of the coolant flow passage located closest to the blade trailing edge is partitioned to have a relatively large width so that the flow of the steam is facilitated in this area, while the end portion of the rib disposed closest to the blade trailing edge is curved toward the corner of the blade located at the trailing edge thereof. By virtue of this arrangement, a sufficient amount of coolant steam is forced to flow to the above-mentioned corner portion of the blade formed by the intersection of the blade tip and the blade trailing edge which is otherwise a dead region where it is most difficult for the coolant steam to flow. In this way, the turbine blade can be obtained which has excellent internal blade cooling performance and reliability.

What is claimed is:

1. A gas-turbine blade comprising:

an internally formed coolant flow passage extending longitudinally in said blade;

at least one reinforcing rib, extending longitudinally and continuously from a blade root to a blade tip, and provided within said coolant flow passage so as to extend in a flow direction of a coolant;

a dorsal wall;

a ventral wall, such that said dorsal wall and said ventral wall of said blade are interconnected by said reinforcing rib; and at least one partition wall formed in said coolant flow passage, wherein said at least one reinforcing rib is disposed at a position in said blade between two adjacent partition walls, so that coolant flow passage portions, located at right and left sides of said reinforcing rib, remain open to coolant flow.

2. A gas-turbine blade as set forth in claim 1, characterized in that said passage portions of said coolant flow passage located at left and right sides of said reinforcing rib are each formed as independent structures, such that said coolant flow passage portions exhibit independent flow characteristics.

3. A gas-turbine blade as set forth in claim 1, characterized in that said blade is structured so that coolant steam is fed to said coolant flow passage and recovered therefrom, the coolant steam is fed through an inlet port projecting forwardly from a root portion of said blade and recovered through an outlet port projecting rearwardly from said blade root portion.

4. A gas-turbine blade as set forth in claim 1, characterized in that said reinforcing rib is disposed only within a portion of said coolant flow passage which is located adjacent to the blade trailing edge, while the other portion of said coolant flow passage is partitioned a number of times at short intervals, such that cross-sections thereof are approximately circular.

5. A gas-turbine blade as set forth in claim 1, said blade being a steam-cooled blade to which coolant steam is fed from a hub side at said trailing edge of said blade, characterized in that a coolant flow channel, located closest to the blade trailing edge, is made wider than the other coolant flow channels in said blade to facilitate the flow of the coolant steam, while an end portion of the reinforcing rib disposed adjacent to said trailing edge of said blade is bent curvilinearly toward a corner portion of said blade.

* * * * *